US007808463B2

(12) United States Patent
Kim

(10) Patent No.: US 7,808,463 B2
(45) Date of Patent: Oct. 5, 2010

(54) DATA DRIVER AND ORGANIC LIGHT EMITTING DISPLAY HAVING THE SAME

(75) Inventor: Yang-Wan Kim, Suwon-si (KR)

(73) Assignee: Samsung SDI Co., Ltd. (KR)

( * ) Notice: Subject to any disclaimer, the term of this patent is extended or adjusted under 35 U.S.C. 154(b) by 1113 days.

(21) Appl. No.: 11/489,648

(22) Filed: Jul. 18, 2006

(65) Prior Publication Data

US 2007/0040764 A1 Feb. 22, 2007

(30) Foreign Application Priority Data

Aug. 17, 2005 (KR) ..... 10-2005-0075438

(51) Int. Cl.
*G09G 3/30* (2006.01)
*G09G 3/32* (2006.01)

(52) U.S. Cl. ..... 345/83; 345/76

(58) Field of Classification Search ..... 345/55–102, 345/204–214, 690–697
See application file for complete search history.

(56) References Cited

U.S. PATENT DOCUMENTS

| | | | | |
|---|---|---|---|---|
| 6,268,841 | B1 * | 7/2001 | Cairns et al. | 345/98 |
| 6,559,821 | B2 * | 5/2003 | Ichikawa et al. | 345/92 |
| 6,809,706 | B2 * | 10/2004 | Shimoda | 345/55 |
| 6,914,388 | B2 * | 7/2005 | Shin et al. | 345/76 |
| 7,619,602 | B2 * | 11/2009 | Shin | 345/98 |
| 2008/0170027 | A1 * | 7/2008 | Kyeong et al. | 345/100 |

* cited by examiner

*Primary Examiner*—David L Lewis
(74) *Attorney, Agent, or Firm*—Knobbe, Martens, Olson & Bear LLP

(57) ABSTRACT

An organic light emitting display having color-specific demultiplexers is disclosed. Each demultiplexer receives a data signal for a specific color and sequentially supplies the data signals to sub-pixels for the specific color. Therefore, a data driving circuit supplying the data signal to the demultiplexer receives and successively processes only data of the specific color, so that power loss due to data charging/discharging operations is reduced when specific color sub-pixels of neighboring pixels receive the data signal corresponding to similar gray-scale voltages.

17 Claims, 4 Drawing Sheets

DATA DRIVER AND ORGANIC LIGHT EMITTING DISPLAY HAVING THE SAME

CROSS-REFERENCE TO RELATED APPLICATION

This application claims priority to and the benefit of Korean Patent Application No. 2005-75438, filed Aug. 17, 2005, which is incorporated herein by reference in its entirety.

BACKGROUND OF THE INVENTION

1. Field of the Invention

The present invention relates to an organic light emitting display, and more particularly, to a data driver and an organic light emitting display using demultiplexers, and the data driver supplies data signals for the same color to each demultiplexer.

2. Description of the Related Technology

Alternative to cathode ray tube (CRT) displays, flat panel displays are today popular. In particular, an organic light emitting display has excellent brightness and viewing angle characteristics, and thus, is believed by many to be the next generation of flat panel displays.

Unlike a liquid crystal display (LCD), the organic light emitting display employs a light emitting diode to emit light without a separate light source. Such a light emitting diode emits light corresponding to the a driving current flowing in an anode electrode.

FIG. 1 illustrates a conventional organic light emitting display.

The organic light emitting display includes a pixel portion 10, a scan driver 20, a data driver 30, and an emission control driver 40.

The scan driver 20 sequentially supplies scan signals to scan lines S1 through Sn in response to a scan control signal, i.e., a start pulse and a clock signal, from a timing controller (not shown).

The data driver 30 supplies data voltages corresponding to red (R), green (G) and blue (B) data to data lines D1 though Dm in response to a data control signal from the timing controller.

The emission control driver 40 includes a shift register, etc., and sequentially supplies emission control signals to emission control lines E1 through En in response to the start pulse and the clock signal from the timing controller.

The pixel portion 10 includes a plurality of pixels P11 through Pnm placed in regions where a plurality of scan lines S1 through Sn, a plurality of data lines DR1 through DBm, and a plurality of emission control lines E1 through En intersect with one another. Here, the pixel portion 10 displays an image corresponding to the applied data voltage.

Note that, one unit pixel Pnm includes red, green and blue sub-pixels PRnm, PGnm and PBnm.

The red, green and blue sub-pixels PRnm, PGnm and PBnm of the pixel portion 10 are structured to have the same pixel circuits, and emit red, green and blue light corresponding to the current applied to an organic light emitting diode, respectively. Thus, the pixel Pnm displays a color obtained by combining the light emitted by the red, green and blue sub-pixels PRnm, PGnm and PBnm.

The organic light emitting display is in need of m×3 data driving circuits supplying the data signals to m×3 (red, green and blue) data lines connecting the data driver 30 with the pixel portion 10. However, due to the size and the manufacturing cost of a panel, it is difficult to provide the organic light emitting display with a data driving circuit for each of the data lines. As the number of pixels increases, the organic light emitting display needs to have more data driving circuits.

FIG. 2 illustrates a data driver of the conventional organic light emitting display.

Referring to FIG. 2, the conventional organic light emitting display includes the data driver 30 having a demultiplexer 32.

The data driver 30 includes m demultiplexers 32 supplying the data signals to the data lines DRm, DGm, DBm corresponding to the red, green and blue sub-pixels PRnm, PGnm and PBnm of the pixel portion 10, respectively, and m data driving circuits 31 connected to the respective demultiplexers 32 and supplying the red, green and blue data signals to the respective demultiplexers 32.

Each data driving circuit 31 receives red, green and blue data from the timing controller and processes them in order to supply the red, green and blue data signals to data output lines DLm.

The data output lines DLm sequentially supply the red, green and blue data signals to input terminals of the demultiplexer 32.

The demultiplexer 32 sequentially supplies the data signals to the red, green or blue sub-pixels PRnm, PGnm and PBnm in response to the control signal of the timing controller, respectively.

Thus, one demultiplexer 32 supplies the data signals to three data lines DRm, DGmm and DBm, so that the number of data driving circuits is reduced to ⅓ of the number of sub-pixel columns.

However, in the conventional organic light emitting display, the organic light emitting diodes displaying red, green and blue of the pixel Pnm are different in emission efficiency according to colors, so that a gamma value should be selected for one data driving circuit 31 differently according to red, green and blue when all the red, green and blue data are processed by one data driving circuit 31. Therefore, even though white is displayed, the data driving circuit supplies red, green and blue data with different gamma values from thereby increasing power consumption due to the changes in data input.

SUMMARY OF CERTAIN INVENTIVE ASPECTS

Certain embodiments provide an organic light emitting display supplying a data signal using demultiplexers, and data driving circuits to supply a data signal to each pixel.

One embodiment is an organic light emitting display including a pixel portion having a plurality of pixels, each pixel including red, green and blue sub-pixels. The pixel portion is configured to display an image. The display also includes a scan driver configured to supply a scan signal to the pixel portion, an emission control driver configured to supply an emission control signal to the pixel portion, a data driving circuit configured to generate a plurality of analog data signals for a specific color by receiving and processing digital video signals of the specific color, and a demultiplexer configured to receive the analog data signals from the data driving circuit, and to sequentially supply the analog data signals to at least two sub-pixels configured to emit light of the specific color.

Another embodiment is a data driver configured to supply data signals to pixels including red, green and blue sub-pixels. The data driver includes a data driving circuit configured to generate an analog data signal for a specific color by receiving and processing a digital video signal for the specific color, where the specific color is one of red, green and blue, and a demultiplexer configured to receive the analog data signal from the data driving circuit, and to sequentially supply the received analog data signal to at least two pixels.

Another embodiment is a data driver configured to supply data signals to pixels, each pixel including red, green and blue sub-pixels. The data driver includes a data driving circuit configured to generate an analog data signal for a specific color by receiving and processing a digital video signal for the specific color, where the specific color is one of red, green and blue, and a demultiplexer configured to receive the analog data signal from the data driving circuit, and to supply the received analog data signal to the sub-pixels, where the demultiplexer includes a red demultiplexer configured to receive a red data signal from the data driving circuit, a green demultiplexer configured to receive a green data signal from the data driving circuit, and a blue demultiplexer configured to receive a blue data signal from the data driving circuit.

BRIEF DESCRIPTION OF THE DRAWINGS

The above and other features of certain embodiments will be described in reference to the attached drawings in which.

DETAILED DESCRIPTION OF CERTAIN INVENTIVE EMBODIMENTS

Hereinafter, embodiments of the present invention will be described with reference to accompanying drawings.

Figure 1:
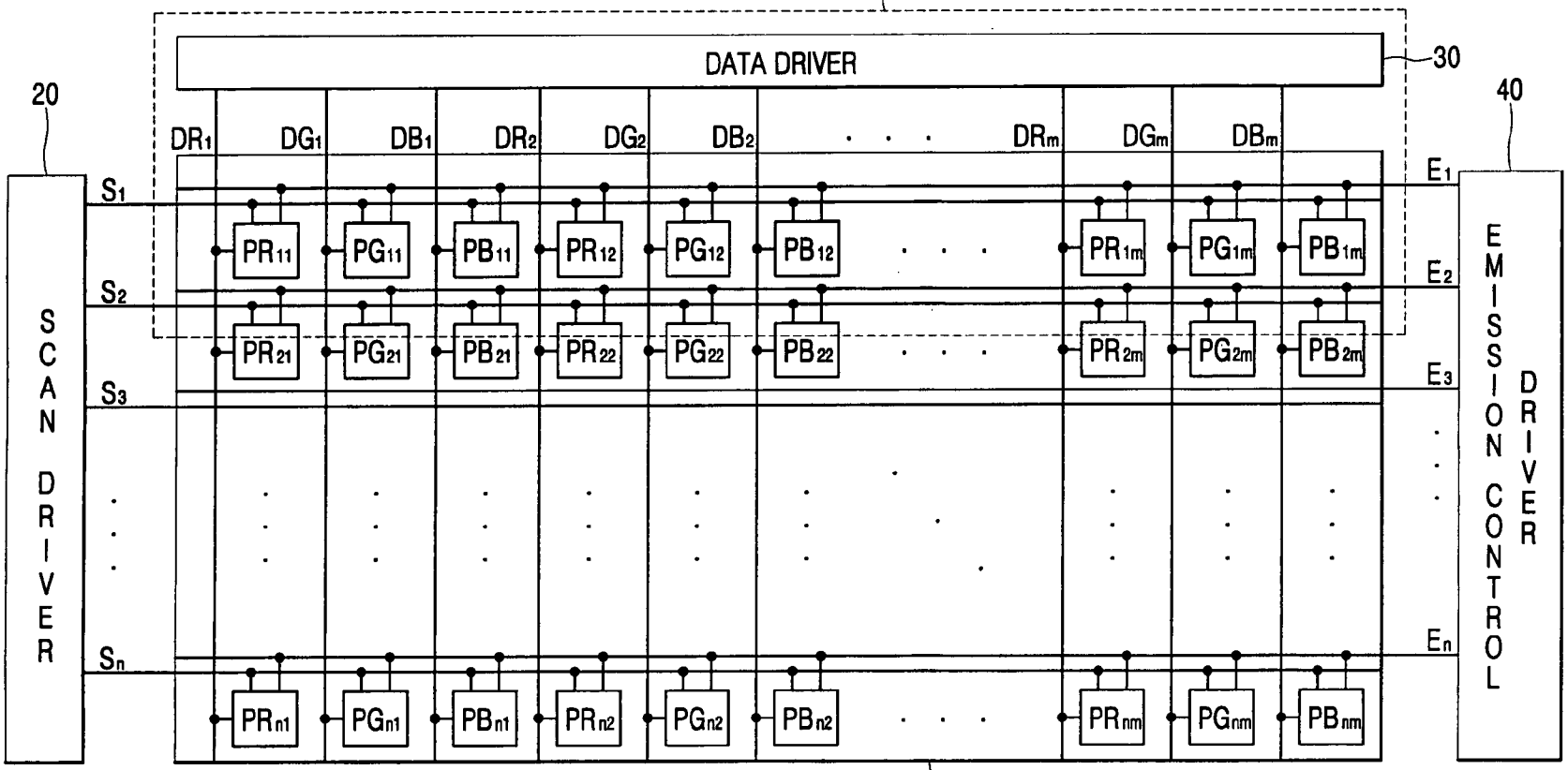
FIG. 1 (PRIOR ART)
FIG. 1 is a schematic drawing illustrating a conventional organic light emitting display.
Figure 2:
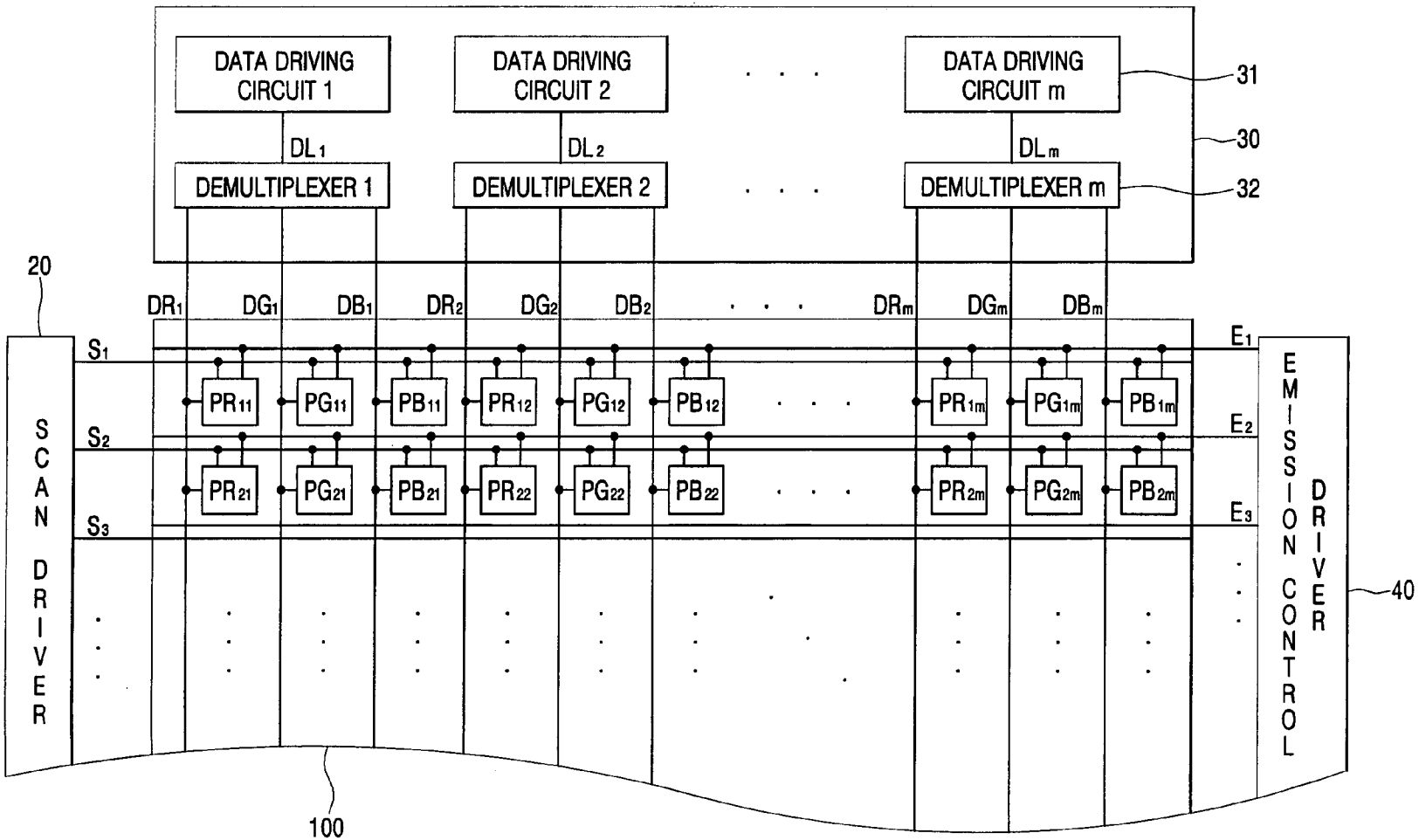
FIG. 2 (PRIOR ART)
FIG. 2 is a schematic drawing illustrating a data driver of the conventional organic light emitting display.
Figure 3:
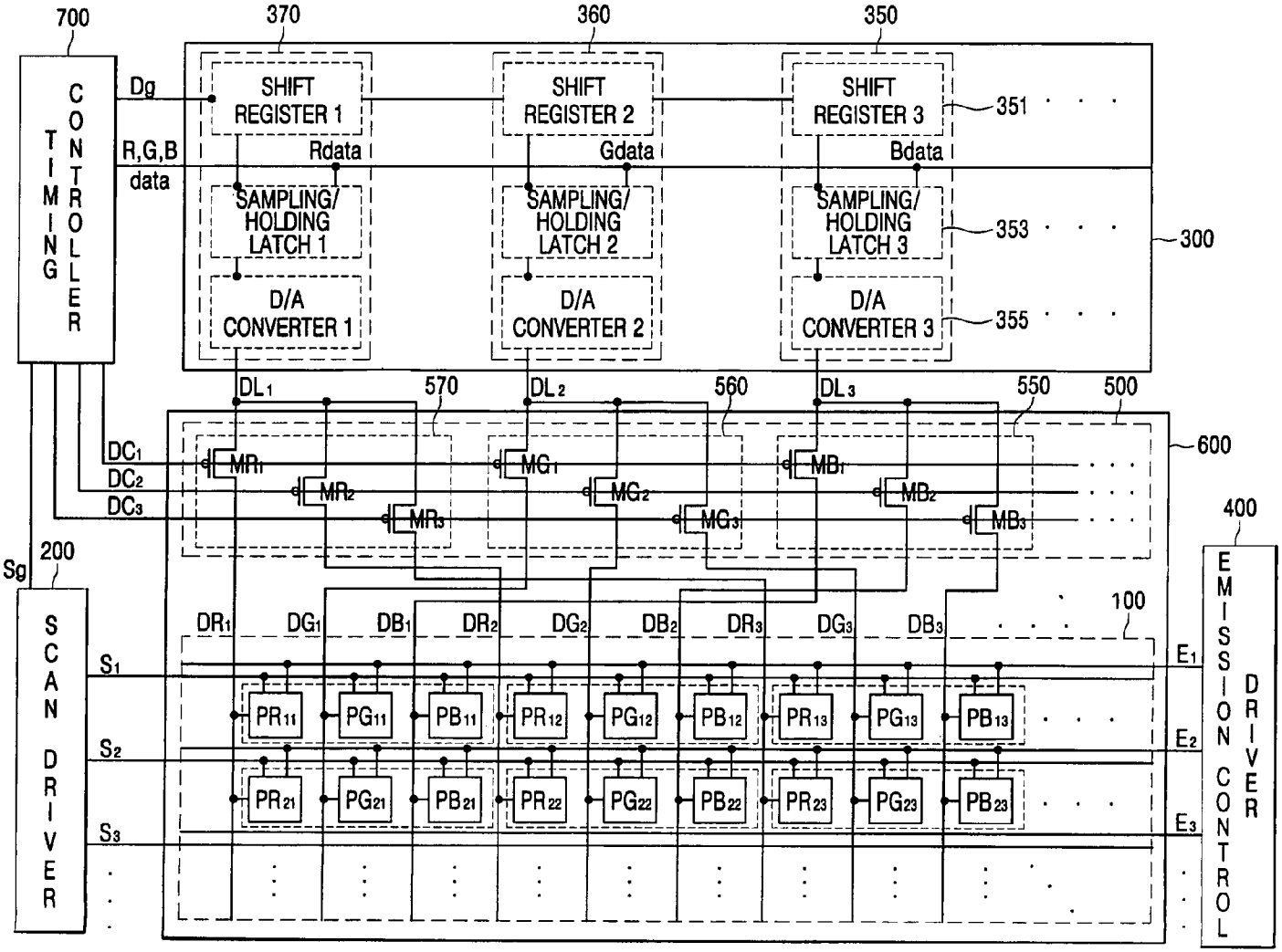
FIG. 3 is a schematic drawing illustrating an organic light emitting display according to an embodiment of the present invention.

FIG. 3 illustrates an organic light emitting display according to one embodiment.

Referring to FIG. 3, the organic light emitting display includes a pixel portion 100, a scan driver 200, an emission control driver 400, a data driver 300, a demultiplexer 500, and a timing controller 700.

The pixel portion 100 includes a plurality of pixels P11 through Pnm formed in regions which are defined by a plurality of scan lines S1 through Sn, a plurality of emission control lines E1 through En, and a plurality of data lines DR1 through DBm. Each pixel Pnm includes red, green and blue sub-pixels PRnm, PGnm and PBnm, which are respectively connected to the data lines DRm, DGm and DBm to receive data signals.

The red, green and blue sub-pixels PRnm, PGnm and PBnm of the pixel Pnm are structured to have the same pixel circuits, and to emit red, green and blue light corresponding to the current applied to an organic light emitting diode (OLED), respectively. Thus, the pixel Pnm generates a color by combining the light emitted by the red, green and blue sub-pixels PRnm, PGnm and PBnm.

The scan driver 200 sequentially supplies scan signals to the plurality of scan lines S1 through Sn in synchronization with a scan control signal Sg, i.e., start pulse and clock signals, from the timing controller 700.

The emission control driver 400 may include a shift register to sequentially supply emission control signals in synchronization with a control signal (not shown), i.e., the start pulse and clock signals, from the timing controller 700. Alternatively, the emission control signal may be generated by performing a logical operation on output signals of the shift register or the scan signals output from the scan driver 200 without the emission control driver 400.

The data driver 300 receives R, G and B digital video signals and a control signal Dg from the timing controller 700. Further, the data driver 300 includes a plurality of data driving circuits to supply the data signals to a plurality of data output lines DL1 through DLm.

For example, the data driver 300 includes a red data driving circuit 370, a green data driving circuit 360, and a blue data driving circuit 350 to receive a red digital video signal, a green digital video signal, and a blue digital video signal from the timing controller 700, respectively.

The red data driving circuit 370 includes a shift register 351, a sampling/holding latch 353, and a digital/analog (D/A) converter 355.

The shift register 351 includes a flip-flop receiving a control signal Dg of the start pulse and the clock signal from the timing controller 700, and generating an output signal to control sampling latches corresponding to the data bit number of one sub-pixel.

The sampling/holding latch 353 is composed of sampling latches receiving the red digital video signal and the output signal from the timing controller 700 and the flip-flop of the shift register 351, respectively, and sampling the red digital video signal. In the case where data to be converted into an analog data signal represents 6 bits, i.e., 64 gray scale values, the sampling/holding latch 353 includes six sampling latches. Further, the sampling/holding latch 353 includes a plurality of holding latches to receive and store data sampled by each sampling latch, and output it to the D/A converter 355. Thus, the red data driving circuit 370 includes six holding latches and six sampling latches.

The red data driving circuit 370 includes the D/A converter 355 to convert the data of the holding latches into one of 64 gray scale voltages. Here, the D/A converter 355 converts upper-bit data into an analog value, and divides the converted analog voltage according to lower-bit data, thereby outputting a red analog data signal to the data output line DL1.

Also, the green data driving circuit 360 includes a shift register 351, a sampling/holding latch 353, and a D/A converter 355.

The shift register 351 includes a flip-flop receiving the control signal Dg of the output signal and the clock signal from the flip-flop of the red data driving circuit 370, and generating an output signal to control sampling latches corresponding to the data bit number of one sub-pixel.

The sampling/holding latch 353 is composed of sampling latches receiving the green digital video signal and the output signal from the timing controller 700 and the flip-flop of the shift register 351, respectively, and sampling the green digital video signal. In the case where data to be converted into an analog data signal represents 6 bits, i.e., 64 gray scale values, the sampling/holding latch 353 includes six sampling latches. Further, the sampling/holding latch 353 includes a plurality of holding latches to receive and store data sampled by each sampling latch, and output it to the D/A converter 355. Thus, the green data driving circuit 360 includes six holding latches and six sampling latches.

The green data driving circuit 360 includes the D/A converter 355 to convert the data of the holding latches into one of 64 gray scale voltages. Here, the D/A converter 355 converts upper-bit data into an analog value, and divides the converted analog voltage according to lower-bit data, thereby outputting a green analog data signal to the data output line DL2.

Further, the blue data driving circuit 350 is composed of a shift register 351, a sampling/holding latch 353, and a D/A converter 355.

The shift register 351 includes a flip-flop receiving the control signal Dg of the output signal and the clock signal from the flip-flop of the red data driving circuit 370, and generating an output signal to control sampling latches corresponding to the data bit number of one sub-pixel.

The sampling/holding latch 353 is composed of sampling latches receiving the blue digital video signal and the output signal from the timing controller 700 and the flip-flop of the shift register 351, respectively, and sampling the blue digital video signal. In the case where data to be converted into an analog data signal represents 6 bits, i.e., 64 gray scale values, the sampling/holding latch 353 includes six sampling latches. Further, the sampling/holding latch 353 includes a plurality of holding latches to receive and store data sampled by each sampling latch, and output it to the D/A converter 355. Thus, the blue data driving circuit 350 includes six holding latches and six sampling latches.

The blue data driving circuit 350 includes the D/A converter 355 to convert the data of the holding latches one of 64 gray scale voltages. Here, the D/A converter 355 converts upper-bit data into an analog value, and divides the converted analog voltage according to lower-bit data, thereby outputting a blue analog data signal to the data output line DL3.

The 64 gray scale values for each of the colors are different according because the pixel portion 100 of the organic light emitting display includes organic light emitting diodes different in emission efficiency according to red, green and blue colors.

Further, each data driving circuit 350 includes a level shifter to increase the amplitude of output data from the holding latches and supply it to the D/A converter 355.

The organic light emitting display includes a demultiplexer 600 receiving the data signals from the data output lines DL1, DL2, DL3 . . . of the data driving circuits 350, 360, 370, . . . , and sequentially supplying the data signals to the plurality of pixels P11 through Pnm.

The demultiplexer 600 includes a red demultiplexer 570 receiving k red data signals from the red data driving circuit 370 and supplying the data signals to red sub-pixels PR11 through PR1*k* of k pixels P11 through P1*k*.

The red demultiplexer 570 is composed of k transistors MR1 through MRk which are sequentially turned on in response to control signals DC1 through DCk of the timing controller 700 and supply the red data signals to the data lines DR1 through DRk of the plurality of red sub-pixels PR11 through PR1*k*. Here, the k transistors MR1 through MRk are connected in common to the data output line DL1 of the red data driving circuit 370 and receive the data signal.

The demultiplexer 500 includes a green demultiplexer 560 receiving k green data signals from the green data driving circuit 360 and supplying the data signals to green sub-pixels PG11 through PG1*k* of the k pixels P11 through P1*k*.

The green demultiplexer 560 is composed of k transistors MG1 through MGk which are sequentially turned on in response to the control signals DC1 through DCk of the timing controller 700 and supply the data signals to the data lines DG1 through DGk of the plurality of green sub-pixels PG11 through PG1*k*. Here, the k transistors MG1 through MGk are connected in common to the data output line DL2 of the green data driving circuit 360 and receive the data signal.

The demultiplexer 500 includes a blue demultiplexer 550 receiving k blue data signals from the blue data driving circuit 350 and supplying the data signals to blue sub-pixels PB11 through PB1*k* of the k pixels P11 through P1*k*.

The blue demultiplexer 550 is composed of k transistors MB1 through MBk which are sequentially turned on in response to the control signals DC1 through DCk of the timing controller 700 and supply the data signals to the data lines DB1 through DBk of the plurality of blue sub-pixels PB11 through PB1*k*. Here, the k transistors MB1 through MBk are connected in common to the data output line DL3 of the blue data driving circuit 350 and receive the data signal.

Transistors MR1 through MBk of the demultiplexer 500 are formed of p-channel metal oxide semiconductor field effect transistors (PMOSFETs). Therefore, the transistors MR1 through MBk of the demultiplexer 500 can be fabricated by the same process as the transistors of the pixel circuit formed in the pixel portion 100. The demultiplexer 500 is formed on the same substrate as the pixel portion 100 and realizes a system-on-panel (SOP).

The red, green and blue data driving circuits 370, 360 and 350 receive digital video signals corresponding to the red, green and blue data signals supplied to the k pixels P11 through P1*k*. Thus, when the pixel portion 100 includes the pixel pixels P11 through Pnm in m columns, m/k red, green and blue data driving circuits may be provided to thereby reduce the number of data driving circuits.

Figure 4:
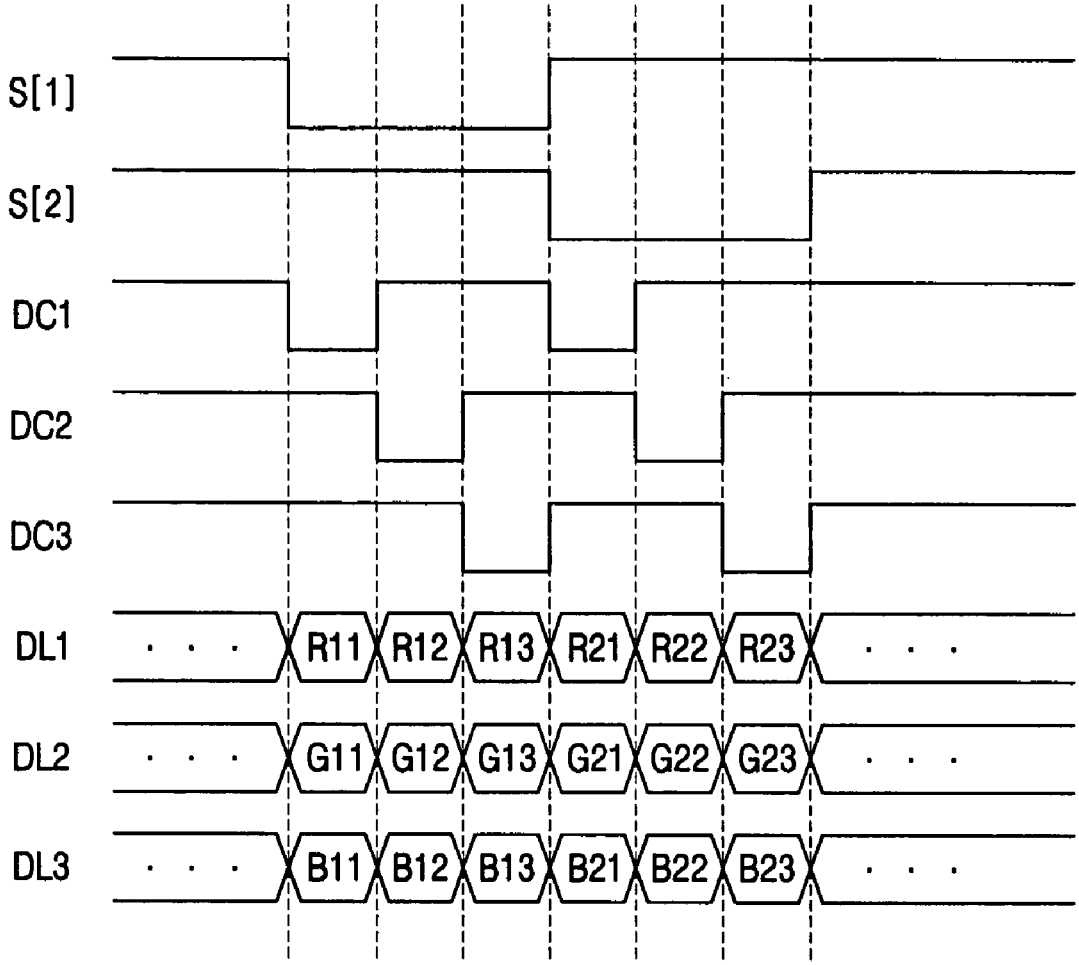
FIG. 4 is a timing diagram showing operation of the organic light emitting display according to an embodiment of the present invention.

FIG. 4 is a timing diagram showing the operation of an organic light emitting display according to one embodiment.

Referring to FIG. 4, the organic light emitting display of FIG. 3 operates as follows. Hereinafter, it is assumed that the number of pixels receiving a data signal from one demultiplexer is three (i.e., k=3). Thus, red, green and blue data driving circuits 370, 360 and 350 and pixels P11 through Pn3 receiving the respective data signals from the red, green and blue data driving circuits 370, 360 and 350 will be representatively described below.

When a first scan signal of a low level is supplied from the scan driver 200 to the pixel portion 100, $1^{st}$ row pixels P11 through P1*m* of the pixel portion 100 are activated. At this time, the sampling/holding latch 353 of the $1^{st}$ red data driving circuit 370 samples and holds data corresponding to the gray scale of the red sub-pixel PR11 in the $1^{st}$ row and $1^{st}$ column. Then, the data is converted by the D/A converter 355 of the $1^{st}$ red data driving circuit 370 into a red data signal having an analog voltage, and output to a data output line DL1.

At this time, a transistor MR1 connected to data line DR1 of the $1^{st}$ column red sub-pixels PR11 through PRn1 of the red demultiplexer 570 is turned on in response to the first demultiplexer control signal DC1 supplied from the timing controller 700. Therefore, the data signal is supplied to the red sub-pixel PR11 in the $1^{st}$ row and column, thereby allowing the red sub-pixel PR 11 in the $1^{st}$ row and $1^{st}$ column to emit red light corresponding to the data signal.

Further, the sampling/holding latch 353 of the $1^{st}$ green data driving circuit 360 samples and holds data corresponding to the gray scale of the green sub-pixel PG11 in the $1^{st}$ row and $1^{st}$ column. Then, the data is converted by the D/A converter 355 of the $1^{st}$ green data driving circuit 360 into a green data signal having an analog voltage, and output to a data output line DL2.

At this time, a transistor MG1 connected to data line DG1 of the $1^{st}$ column green sub-pixels PG11 through PGn1 of the green demultiplexer 560 is turned on in response to the first demultiplexer control signal DC1 supplied from the timing controller 700. Therefore, the data signal is supplied to the green sub-pixel PG11 in the $1^{st}$ row and column, thereby allowing the green sub-pixel PG11 in the $1^{st}$ row and $1^{st}$ column to emit green light corresponding to the data signal.

Also, the sampling/holding latch 353 of the $1^{st}$ blue data driving circuit 350 samples and holds data corresponding to the gray scale of the blue sub-pixel PB11 in the $1^{st}$ row and $1^{st}$ column. Then, the data is converted by the D/A converter 355 of the $1^{st}$ blue data driving circuit 350 into a blue data signal having an analog voltage, and output to a data output line DL3.

At this time, a transistor MB1 connected to the data line DB1 of the $1^{st}$ column blue sub-pixels PB11 through PBn1 of the blue demultiplexer 550 is turned on in response to the first demultiplexer control signal DC1 supplied from the timing controller 700. Therefore, the data signal is supplied to the blue sub-pixel PB11 in the $1^{st}$ row and column, thereby allowing the blue sub-pixel PB11 in the $1^{st}$ row and $1^{st}$ column to emit blue light corresponding to the data signal.

Thus, the transistors MR1, MG1 and MB1 connected to the data lines DR1, DG1 and DB1 of the $1^{st}$ row and $1^{st}$ column pixel P11 of the red, green and blue demultiplexers 570, 560 and 550 are turned on at the same time by receiving the first demultiplexer control signal DC1 of a low level from the timing controller 700. Therefore, the red, green and blue sub-pixels PR11, PG11 and PB11 of the $1^{st}$ row and column pixel P11 receive the respective data signals and emit light at the same time. Further, the $1^{st}$ row and $1^{st}$ column pixel P11 combines red, green and blue light, thereby displaying a correct color.

While the first scan signal of a low level is supplied, the data signal is supplied to the $1^{st}$ row and $1^{st}$ column pixel P11, and a data signal is also supplied to the $1^{st}$ row and $2^{nd}$ column pixel P12.

In this case, the sampling/holding latch 353 of the $1^{st}$ red data driving circuit 370 samples and holds data corresponding to the gray scale of the red sub-pixel PB12 in the $1^{st}$ row and $2^{nd}$ column. Then, the data is converted by the D/A converter 355 of the $1^{st}$ red data driving circuit 370 into a red data signal having an analog voltage, and output to the data output line DL1.

At this time, a transistor MR2 connected to a data line DR2 of the $2^{nd}$ column red sub-pixels PR12 through PBn2 of the red demultiplexer 570 is turned on in response to a second demultiplexer control signal DC2 supplied from the timing controller 700. Therefore, the data signal is supplied to the red sub-pixel PR12 in the $1^{st}$ row and $2^{nd}$ column, thereby allowing the red sub-pixel PR12 in the $1^{st}$ row and $2^{nd}$ column to emit red light corresponding to the data signal.

Further, the sampling/holding latch 353 of the $1^{st}$ green data driving circuit 360 samples and holds data corresponding to the gray scale of the green sub-pixel PG12 in the $1^{st}$ row and $2^{nd}$ column. Then, the data is converted by the D/A converter 355 of the $1^{st}$ green data driving circuit 360 into a green data signal having an analog voltage, and output to the data output line DL2.

At this time, a transistor MG2 connected to a data line DG2 of the $2^{nd}$ column green sub-pixels PG12 through PGn2 of the green demultiplexer 560 is turned on in response to the second demultiplexer control signal DC2 supplied from the timing controller 700. Therefore, the data signal is supplied to the green sub-pixel PG12 in the $1^{st}$ row and $2^{nd}$ column, thereby allowing the green sub-pixel PG12 in the $1^{st}$ row and $2^{nd}$ column to emit green light corresponding to the data signal.

Also, the sampling/holding latch 353 of the $1^{st}$ blue data driving circuit 350 samples and holds data corresponding to the gray scale of the blue sub-pixel PB12 in the $1^{st}$ row and $2^{nd}$ column. Then, the data is converted by the D/A converter 355 of the $1^{st}$ blue data driving circuit 350 into a blue data signal having an analog voltage, and output to the data output line DL3.

At this time, a transistor MB2 connected to a data line DB2 of the $2^{nd}$ column blue sub-pixels PB12 through PBn2 of the blue demultiplexer 550 is turned on in response to the second demultiplexer control signal DC2 supplied from the timing controller 700. Therefore, the data signal is supplied to the blue sub-pixel PB12 in the 1st row and $2^{nd}$ column, thereby allowing the blue sub-pixel PB12 in the $1^{st}$ row and $2^{nd}$ column to emit blue light corresponding to the data signal.

Thus, the transistors MR2, MG2 and MB2 connected to the data lines DR2, DG2 and DB2 of the $1^{st}$ row and $2^{nd}$ column pixels P12 of the red, green and blue demultiplexers 570, 560 and 550 receive the second demultiplexer control signal DC2 having a low level from the timing controller 700 and are turned on at the same time. Therefore, the red, green and blue sub-pixels PR12, PG12 and PB12 of the $1^{st}$ row and $2^{nd}$ column pixel P12 emit light at the same time by receiving the respective data signals. Further, the $1^{st}$ row and $2^{nd}$ column pixel P12 combines red, green and blue light, thereby displaying the correct color.

While the first scan signal of a low level is supplied, the data signal is supplied to the $1^{st}$ row and $2^{nd}$ column pixel P12, and a data signal is also supplied to the $1^{st}$ row and $3^{rd}$ column pixel P13. At this time, the $1^{st}$ red data driving circuit 370, the $1^{st}$ green data driving circuit 360 and the $1^{st}$ blue data driving circuit 350 receive the red, green and blue data from the $1^{st}$ row and $3^{rd}$ column pixel P13. The data is sampled from each data driving circuit 370, 360 and 350, and converted into the analog data signal to thereby be supplied to the demultiplexers 570, 560 and 550 through the respective data output lines DL1, DL2 and DL3.

Transistors MR3, MG3 and MB3 connected to data lines DR3, DG3 and DB3 of the $1^{st}$ row and $3^{rd}$ column sub-pixels of the red, green and blue demultiplexers 570, 560 and 550 are turned on in response to a third demultiplexer control signal DC3 simultaneously received from the timing controller 700. Thus, the red, green and blue sub-pixels PR13, PG13 and PB13 in the $1^{st}$ row and $3^{rd}$ column simultaneously receive the respective data signals, and emit red, green and blue light corresponding to the respective data signals. Thus, the $1^{st}$ row and $3^{rd}$ column pixel P13 combines the red, green and blue light and displays the correct color.

The foregoing operations are simultaneously performed in the $1^{st}$, $2^{nd}$, $3^{rd}$ and $(m/k)^{th}$ red, green and blue data driving circuits and the demultiplexers connected to the respective data driving circuits while the first scan signal of a low level is applied. Therefore, the control signals DC1, DC2, . . . are supplied in common from the timing controller 700 to m/k×3 demultiplexers.

In the case where a data signal is supplied from one demultiplexer 550 to k data lines DB1 through DBk, the number of data driving circuits 350 is reduced to m/k×3 (red, green and blue).

Because each data driving circuit 370, 360 and 350 is used for only one of the three sub-pixel colors, digital switching power is saved. Pixels in adjacent columns often have similar brightness. Accordingly, the data for adjacent pixels is similar, and as a result the digital state of the driving circuits 370, 360, and 350 changes less from pixel to pixel than it does in conventional displays, which use driving circuits for multiple sub-pixel colors.

When a second scan signal of a low level is supplied from the scan driver 200 to the pixel portion 100, $2^{nd}$ row pixels P21 through P2*m* of the pixel portion 100 are activated.

At this time, the $1^{st}$ red, green and blue data driving circuits 370, 360 and 350 receive and sample data for the $2^{nd}$ row and $1^{st}$ column pixel P21, and output red, green and blue data signals having analog voltages. The respective red, green and blue data signals are supplied to red, green and blue sub-pixels PR21, PG21 and PB21 of the $2^{nd}$ row and $1^{st}$ column pixel P21 through the transistors MR1, MG1 and MB1 which are turned on in response to the first demultiplexer control signal DC1 supplied from the timing controller 700. Here, the $2^{nd}$ row and $1^{st}$ column red, green and blue sub-pixels PR21, PG21 and PB21 receive the respective data signals at the same time, and emit red, green and blue light corresponding to the data signals. Thus, the $2^{nd}$ row and $1^{st}$ column pixel P21 combines the red, green and blue light to thereby display the correct color.

After supplying the data signals to the $2^{nd}$ row and $1^{st}$ column pixel P21, the $1^{st}$ red, green and blue data driving circuits 370, 360 and 350 receive and sample data for the $2^{nd}$ row and $2^{nd}$ column pixel P22, and output the red, green and blue data signals having analog voltages. The red, green and blue data signals are supplied to red, green and blue sub-pixels PR2, PG22 and PB22 of the $2^{nd}$ row and $2^{nd}$ column pixel P22 through the transistors MR2, MG2 and MB2 which are turned on in response to the second demultiplexer control signal DC2 supplied from the timing controller 700, respectively. Here, the $2^{nd}$ row and $2^{nd}$ column red, green and blue sub-pixels PR22, PG22 and PB22 receive the respective data signals at the same time, and emit red, green and blue light corresponding to the data signals. Thus, the $2^{nd}$ row and $2^{nd}$ column pixel P22 combines the red, green and blue light to thereby display the correct color.

After supplying the data signal to the $2^{nd}$ row and $2^{nd}$ column pixel P22, the $1^{st}$ red, green and blue data driving circuits receive and sample data for the $2^{nd}$ row and $3^{rd}$ column pixel P23, and output the red, green and blue data signals having analog voltages. The red, green and blue data signals are supplied to red, green and blue sub-pixels PR23, PG23 and PB23 of the $2^{nd}$ row and $3^{rd}$ column pixel P23 through the transistors MR3, MG3 and MB3 which are turned on in response to the third demultiplexer control signal DC3 supplied from the timing controller 700, respectively. Here, the $2^{nd}$ row and $3^{rd}$ column red, green and blue sub-pixels PR23, PG23 and PB23 receive the respective data signals at the same time, and emit red, green and blue light corresponding to the data signals. Thus, the $2^{nd}$ row and $3^{rd}$ column pixel P23 combines the red, green and blue light to thereby display a correct color.

The foregoing operations are performed in the $1^{st}$, $2^{nd}$, $3^{rd}$ and $(m/k)^{th}$ red, green and blue data driving circuits and the demultiplexers connected to the respective data driving circuits at the same time while the second scan signal of a low level is applied. Therefore, the control signals DC1, DC2, . . . are supplied in common from the timing controller 700 to m/k×3 demultiplexers.

When a third scan signal of a low level is supplied to the pixel portion 100, $3^{rd}$ row pixels P31 through P3*m* are activated, and the data driver 300 and the demultiplexer 500 repeat the forgoing operations, thereby supplying data signals to the pixels P31 through P3*m*, respectively. Such operations are repeated until one frame is completed as the $n^{th}$ scan signal of a low level is supplied.

As described above, certain embodiments provide an organic light emitting display including demultiplexers, where each demultiplexer receives a data signal corresponding to a specific color and sequentially supplies the data signals to sub-pixels corresponding to the specific color of the k pixels. Therefore, a data driving circuit supplying the data signal to the demultiplexer receives and processes data corresponding to a specific color, so that power loss due to data charging/discharging operations may be reduced when specific color sub-pixels of neighboring pixels receives the data signal corresponding to the same gray-scale voltage.

Although the present invention has been described with reference to certain exemplary embodiments thereof, it will be understood by those skilled in the art that a variety of modifications and variations may be made to the present invention without departing from the spirit or scope of the present invention.

What is claimed is:

1. An organic light emitting display comprising:

a pixel portion having a plurality of pixels, each pixel comprising red, green and blue sub-pixels configured to display an image;

a scan driver configured to supply a scan signal to the pixel portion;

an emission control driver configured to supply an emission control signal to the pixel portion;

a data driving circuit configured to generate a plurality of analog data signals for a specific color by receiving and processing digital video signals of the specific color; and a demultiplexer configured to receive the analog data signals from the data driving circuit, and to sequentially supply the analog data signals to at least two sub-pixels configured to emit light of the specific color, wherein the at least two sub-pixels are in adjacent columns of pixels.

2. The organic light emitting display according to claim 1, wherein the organic light emitting display comprises three data driving circuits, each data driving circuit configured to receive a digital video signal comprising one of red, green and blue data.

3. The organic light emitting display according to claim 2, wherein each of the three data driving circuits comprises a D/A converter configured to convert the received digital video signal into an analog voltage based at least in part on a reference voltage, wherein the reference voltage for one of the three driving circuits has a different value than the reference voltage of another of the three driving circuits.

4. The organic light emitting display according to claim 3, wherein the demultiplexer comprises at least two transistors which are configured to be sequentially turned on and to supply the data signals to data lines of at least two sub-pixels of the specific color.

5. The organic light emitting display according to claim 4, wherein one pixel comprising red, green and blue sub-pixels receives red, green and blue data signals at substantially the same time from the demultiplexers connected to the red, green and blue data driving circuits.

6. The organic light emitting display according to claim 5, wherein the transistors of the demultiplexer are PMOSFETs.

7. The organic light emitting display according to claim 6, wherein the demultiplexer is formed on the same substrate as the pixel portion.

8. A data driver configured to supply data signals to pixels comprising red, green and blue sub-pixels, the data driver comprising:

a data driving circuit configured to generate an analog data signal for a specific color by receiving and processing a digital video signal for the specific color, wherein the specific color is one of red, green and blue; and a demultiplexer configured to receive the analog data signal from the data driving circuit, and to sequentially supply the received analog data signal to at least two sub-pixels, wherein the at least two sub-pixels are in adjacent columns of pixels.

9. The data driver according to claim 8, wherein the data driving circuit comprises a D/A converter configured to convert the digital video signal into an analog voltage based at least in part on a reference voltage, wherein the reference voltage is of a value corresponding to the specific color, and the analog voltage is output as data signals.

10. The data driver according to claim 9, wherein the demultiplexer comprises at least two transistors which are configured to be sequentially turned on and to supply the data signals to data lines of at least two sub-pixels of the specific color.

11. The data driver according to claim 10, wherein the transistors of the demultiplexer are PMOSFETs.

12. The data driver according to claim 8, wherein the demultiplexer and the pixels are formed on the same substrate.

13. A data driver configured to supply data signals to pixels, each pixel comprising red, green and blue sub-pixels, the data driver comprising:

a red data driving circuit configured to generate an analog data signal for only red data by receiving and processing a red digital video signal;

a green data driving circuit configured to generate an analog data signal for only green data by receiving and processing a green digital video signal;

a blue data driving circuit configured to generate an analog data signal for only blue data by receiving and processing a blue digital video signal;

a red demultiplexer configured to receive a red data signal from the red data driving circuit and to sequentially supply the received red data signal to at least two red sub-pixels, wherein the at least two red sub-pixels are in adjacent columns of pixels;

a green demultiplexer configured to receive a green data signal from the green data driving circuit and to sequentially supply the received green data signal to at least two green sub-pixels, wherein the at least two green sub-pixels are in adjacent columns of pixels; and a blue demultiplexer configured to receive a blue data signal from the blue data driving circuit and to sequentially supply the received blue data signal to at least two blue sub-pixels, wherein the at least two blue sub-pixels are in adjacent columns of pixels.

14. The data driver according to claim 13, wherein the red, green and blue demultiplexers are configured to be simultaneously turned on in response to a control signal and to supply the red, green and blue data signals to the corresponding red, green, and blue sub-pixels.

15. The data driver according to claim 14, wherein each demultiplexer comprises PMOSFETs.

16. The data driver according to claim 15, wherein the transistors are connected between data lines and the sub-pixels, and are configured to be turned on and off in response to the control signal.

17. The data driver according to claim 13, wherein the demultiplexers and the pixels are formed on the same substrate.

* * * * *